United States Patent [19]

Bisbing

[11] Patent Number: 4,693,503

[45] Date of Patent: Sep. 15, 1987

[54] LEVER LATCH

[75] Inventor: Robert H. Bisbing, Springfield, Pa.

[73] Assignee: Southco, Inc., Concordville, Pa.

[21] Appl. No.: 837,095

[22] Filed: Mar. 6, 1986

[51] Int. Cl.[4] ..... E05C 3/08

[52] U.S. Cl. ..... 292/210; 292/DIG. 31; 292/DIG. 53; 292/DIG. 60; 292/229

[58] Field of Search ..... 292/229, 107, 337, 113, 292/247, DIG. 53, DIG. 60, DIG. 31, 108

[56] References Cited

U.S. PATENT DOCUMENTS

| | | | |
|---|---|---|---|
| 708,910 | 9/1902 | Noyes | 292/107 |
| 2,337,531 | 12/1943 | Stockton | 292/229 |
| 2,424,962 | 8/1947 | Best | 292/229 X |
| 2,657,085 | 10/1953 | Dedoes | 292/DIG. 31 X |
| 3,012,805 | 12/1961 | Pol | 292/229 |
| 3,047,321 | 7/1962 | Gander | 292/229 X |
| 3,237,978 | 3/1966 | Swanson | 292/113 |
| 3,250,558 | 5/1966 | McClintock | 292/229 |
| 3,515,422 | 6/1970 | Poe | 292/DIG. 31 X |
| 3,694,017 | 9/1972 | Keeler, II et al. | 292/DIG. 31 X |

*Primary Examiner*—Richard E. Moore

*Attorney, Agent, or Firm*—Paul & Paul

[57] ABSTRACT

A latching device comprising a flanged housing and an associated handle and latch for insertion into an opening in a hinged door in which the handle is pivotally attached to the housing and the latch is pivotally attached to the handle with the handle and the latch having front surfaces which are flat and contiguous with each other and positioned substantially flush with the outer door surface when the handle and the latch are in the latched position in which position the latch engages a keeper on the housing. In the preferred embodiment a spring is affixed to the housing for engagement with the latch when the handle and the latch are moved to the latched position thereby holding the latch in engagement with the keeper.

12 Claims, 7 Drawing Figures

LEVER LATCH

BACKGROUND OF THE ART

Latch devices for opening, closing and latching hinged doors and the like have been a part of the prior art for many years. More recently, latch devices have been proposed in which a pivotally mounted and spring biased arm is rotatably mounted on a housing which is inserted into an opening formed in the panel of a hinged door. In these devices the arm is held in the closed position by means of a latch attached to the housing and engaging a keeper integral with one end of the arm. On disengagement of the latch and keeper the arm is freed to pivot to an open position in response to a spring bias and becomes a handle for use in opening and closing the door. In these devices the latch remains rotatably affixed to the housing and does not form a part of the handle nor does it move with the handle to the open position or to the closed position. The arm is relatched when it is returned to the fully closed position with the keeper at the end of the arm once again engaging the latch. These prior latch devices have a number of very real disadvantages such as inadvertent unlatching on impact forces, undesired reengagement of the latch and keeper, striking of the operator's hand by the arm as it opens and accidental opening through inadvertent contact with the projecting part of the latch. In addition, the length of the arm is limited by virtue of the fact that the arm and the latch are totally separated from one another as soon as the latch is moved out of engagement with the keeper at the end of the arm

SUMMARY OF THE INVENTION

The present invention is directed to a combined handle and latch assembly mounted in a flanged housing which is constructed for mounting in an opening formed in a hinged door attached to a cabinet or the like with the outer contiguous surfaces of the handle and latch being substantially flush with the outer surface of the housing when the latch and handle are in the fully closed and latched position. In this closed position the latch, which is rotatably attached to the handle at one end thereof, engages a keeper which is fixedly attached to the housing. The handle is spring biased toward the open position and the latch is spring biased toward a position in which its outer surface is contiguous with the outer surface of the handle and in which the latch forms an extension of the arm. The handle is provided with an arm extending at an angle from the handle. A stop extends from the end of the arm for engagement with the inner surface of a cabinet when the door is closed and latched. A mounting bracket is provided for attaching the housing within an opening formed in the door. In the preferred embodiment of the invention a leaf spring is mounted on a cross web of the housing in a position wherein the leaf spring engages the latch in its closed position in order to hold it closed against the keeper. The above combination of elements provides a combined handle and latch mechanism of unitary configuration which is positioned substantially flush with the door outer surface when in closed and latched position and in which the rotatable latch forms an extension of the handle. In the preferred form of the invention the latching action is reinforced by the leaf spring. However, if such reinforcement is not needed in the particular contemplated use, the leaf spring may be omitted.

DESCRIPTION OF THE PREFERRED EMBODIMENT

Figure 1:
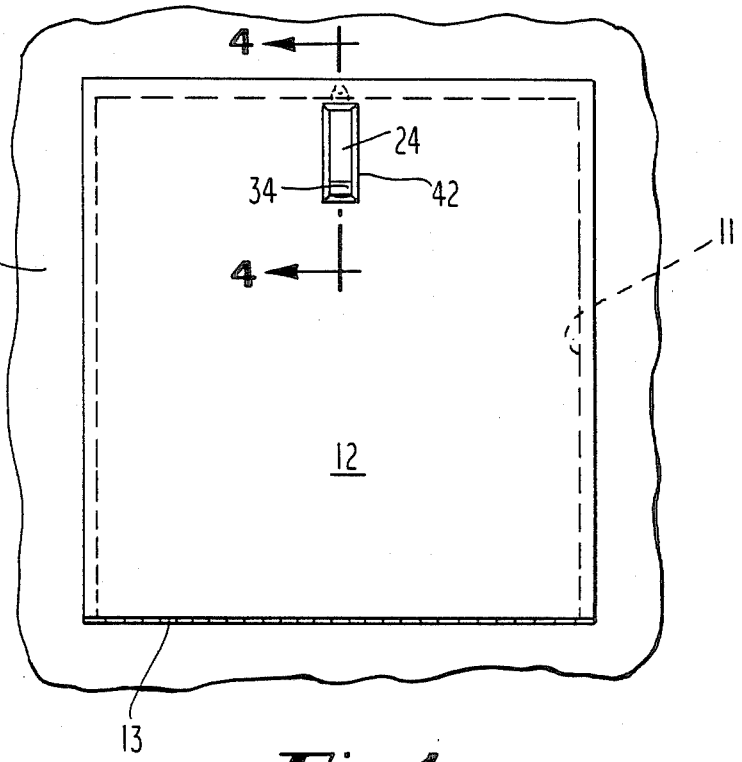
FIG. 1 is a front elevation view, partly broken away, showing a cabinet and attached door with the arm and latch and housing of the present invention inserted into an opening in the door.
Figure 3:
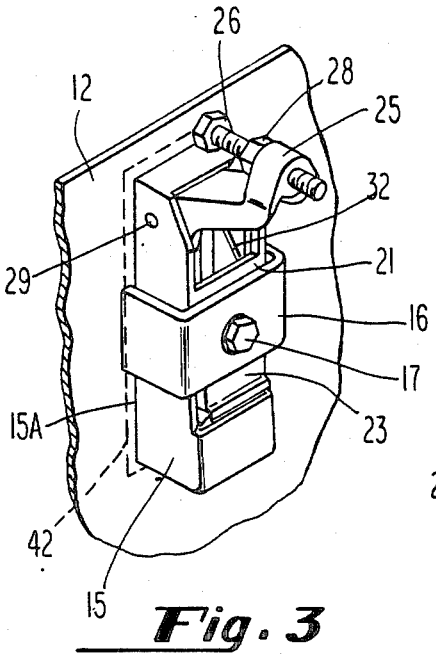
FIG. 3 is an isometric view of the door and housing of FIG. 1 taken from the inside of the door and showing the mounting bracket.

The preferred embodiment of the present invention is shown in the drawings, comprising FIGS. 1 to 7 inclusive. FIG. 1 shows the lever latch device of the present invention mounted in an opening 15A formed in a door 12 which is shown closed over an opening 11 in a cabinet 10. As shown in FIG. 1 the handle 24 and the outer surface of latch 34 are contiguous and flush with the flange 42 of housing 15 since the door 12 is closed and latched. The door 12 is provided with a hinge 13. Door 12 swings open and shut with its axis of rotation corresponding to the axis of hinge 13.

Figure 2:
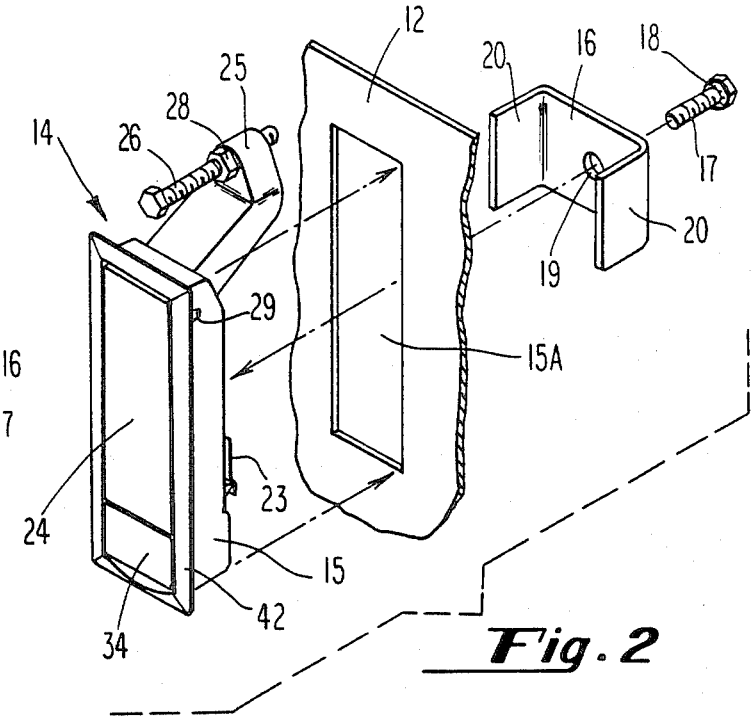
FIG. 2 is an exploded isometric view of the door and door opening and the housing of FIG. 1 and a mounting bracket.
Figure 6:
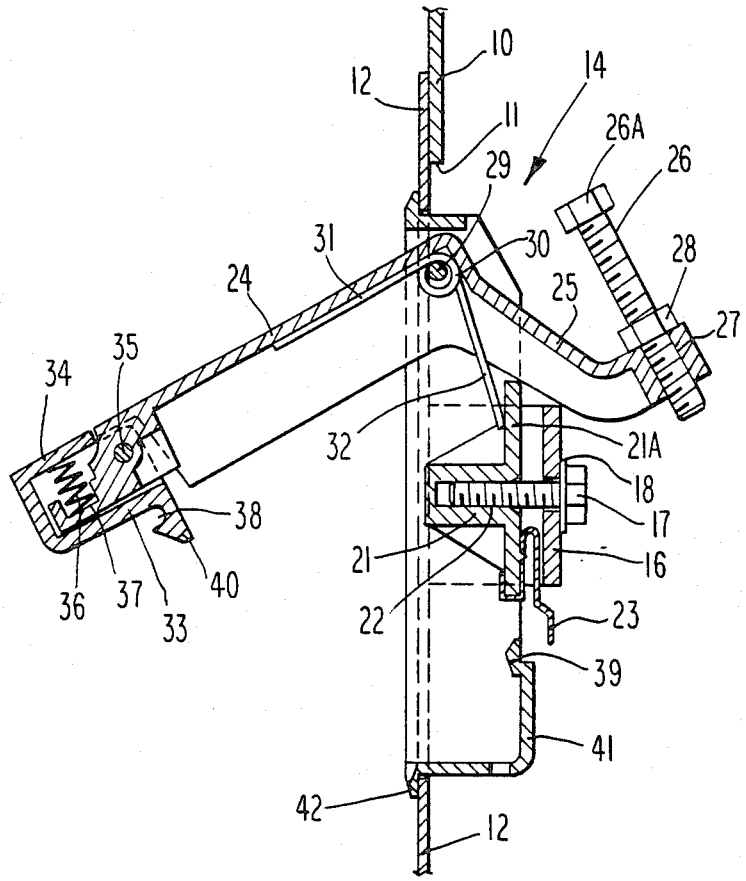
FIG. 6 is a cross-sectional view similar to FIG. 4 of the door and latch with the latch handle and its attached latch in the raised and open position.
Figure 4:
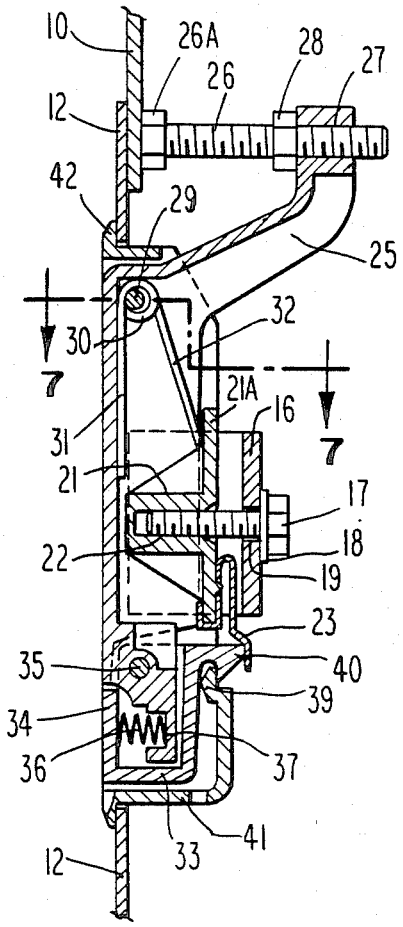
FIG. 4 is a sectional view taken along the lines 4—4 of FIG. 1 with the door in the closed and latched position.
Figure 7:
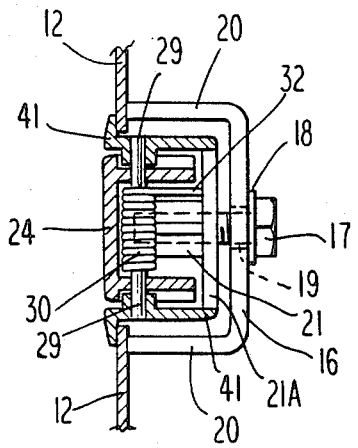
FIG. 7 is a cross-sectional view taken along the lines 7—7 of FIG. 4.

In FIG. 2 of the drawings there is shown a housing assembly 14 which is adapted to fit within an opening 15A formed in door 12. Cabinet 10 is not shown in FIG. 2 for purposes of clarity, but the relationship of cabinet 10 to door 12 is shown in FIGS. 4 and 6. Housing 15 is provided with a flange 42 which engages the outer surface of door 12 when housing 15 is inserted fully into opening 15A. Housing 15 is held in position by mounting bracket 16 and its flange elements 20 which engage the rear surface of door 12 as shown in FIG. 7 when bracket 16 is mounted. Bracket 16 is held in position by a threaded mounting bolt 17 having a lock washer 18. Bolt 17 is inserted through opening 19 formed in bracket 16 and ultimately engages the threads 22 of latch frame boss 21 as shown in FIGS. 3, 4, 6 and 7. Cross web 21A provides a stop for arm 32 of spring 30. A second arm 31 of spring 30 contacts the inner surface of handle 24 which is thereby spring biased towards the open position as shown in FIG. 6. Handle 24 is pivotally mounted on housing 15 on pin 29.

Handle 24 is provided with a handle adjustment bracket 25 which has a threaded opening 27 at its far end. Adjustable bolt 26 is mounted in threaded opening 27 and is locked in fixed position by the action of jam nut 28 which is tightened to set the adjustment. The head 26A of adjustable bolt 26 is positioned to contact the back surface of cabinet 10 when handle 24 is moved to its closed and latched position as in FIG. 4. Flange 42 engages the outer surface of door 12 and it is held there by mounting bracket 16, thus securing housing 15 to the door 12.

Figure 5:
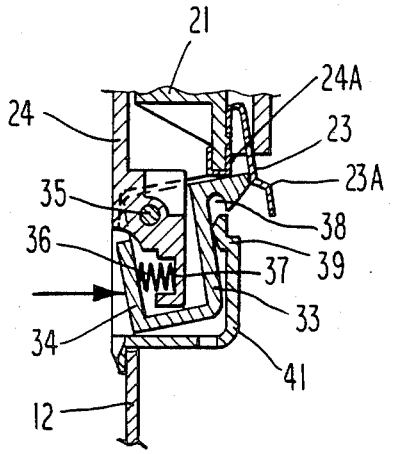
FIG. 5 is a fragmentary cross-sectional view of the latching mechanism of FIG. 4 in the unlatched position, but with the door in the closed position.

Leaf spring 23, which is a part of the preferred embodiment of the present invention, is U-shaped at one end to provide a channel 24A which fits snugly over the edge of cross web 21A as shown in FIGS. 4 and 6. At its other end leaf spring 23 is provided with an extension 23A which lies in the path of nose 40 of latch 33 when handle 24 is moved to its closed position as in FIG. 4. It should be noted that spring 23 may be omitted by simply disengaging it from cross web 21A. For some purposes this provides a satisfactory configuration for the present invention, but spring 23 forms a part of the preferred embodiment since it contributes to satisfactory performance in a wider range of use. Latch 23 is pivotally mounted on latch pin 35 which is mounted in downward extensions of handle 24 and is provided with an engagement groove 38 which fits over the end of keeper 39 when handle 24 is moved to its closed and latched position as in FIG. 4. Latch spring 36 is mounted in spring seat 37 which is a fixed extension of handle 24. Pressure on latch button 34 against the bias of spring 36 rotates latch 33 to the open position as in FIG. 5. In this position handle 24 is moved to the open position of FIG. 6 by the bias exerted by torsion spring 30. In this open position bracket 25 engages the edge of cross web 21A. Handle 24 thus is provided with a stop at each end of its travel from fully open against the edge of cross web 21A to fully closed by engagement of the end of bolt 26 with the inner surface of cabinet 10. In this fully closed position the action of the end of bolt 26 against cabinet wall 10, door 12 and flange 42 acts to hold door 12 firmly in closed position until such time as latch 33 is moved to the position shown in FIG. 5 and handle 24 and its extension 33 is used to open door 12. Latch housing 41 is provided to enclose latch 33 and to provide a keeper 39 at its upper end as shown in FIGS. 4, 5 and 6.

OPERATION OF THE INVENTION

With door 12 in the fully closed position and handle 24 and its extension 33 closed and flush with the outer surface of flange 42, latch 33 is engaged with keeper 39 as in FIG. 4. Door 12 is thus effectively held closed by the force exerted by adjustable bolt 26 against the inner surface of cabinet 10. In the preferred embodiment this closed position is further insured by the action of leaf spring 23 against nose 40 of latch 33 which holds latch 33 against keeper 39. This holding action is supplemented by the force generated by spring 36 against the back surface of latch button 34. To open door 12 from this closed and latched position it is first necessary to disengage latch 33 from keeper 39. This is accomplished by pushing inwardly on latch button 34 against the bias of latch spring 36 as shown by the arrow in FIG. 5. This causes latch 33 to rotate counterclockwise around latch pin 35 which is mounted at the end of handle 24. The nose 40 of latch 33 is thereby raised against the holding force of leaf spring 23 whereupon groove 38 is raised out of engagement with keeper 39. Handle 24 and associated latch button surface 34 and latch 33 are moved to the open position as in FIG. 6 in response to the force exerted by spring 30. In this open position handle 24 and its extension 33 may be used as a handle to open door 12 which is now free to swing on hinge 13. At this time the end of adjustable bolt 26 has been lowered to a position as in FIG. 6 by the clockwise rotation of handle 24 and its extension bracket 25, in which it will clear the opening 11 in cabinet 10 as door 12 is swung open. With leaf spring 23 mounted over the edge of cross web 21A the maximum benefits of the present invention are obtained. However, even without this preferred element of the invention satisfactory results are obtained in many cases.

In order to close and latch door 12 the door is moved inwardly by means of handle 24 and its extension 33 until the end of bolt 26 has cleared the edge of opening 11. Handle 24 and associated extension 34 are then rotated counterclockwise as a unit until they are flush with the outer surface of flange 42. By a pushing action on handle 24 latch 33 engages keeper 39 in groove 38 and nose 40 of latch 33 snaps into engagement with leaf spring 23 as shown in FIG. 4. In this position latch 33 is firmly held in engagement with keeper 39 so that disengagement is possible only by pushing inwardly on button 34 in opposition to the bias force exerted by latch spring 36 and the force exerted by leaf spring 23. This moves latch 33 to the unlatched position shown in FIG. 5. The bias exerted by spring 30 on handle 24 rotates handle 24 and its extension 34 in a clockwise direction as shown in FIG. 6 whereupon a handle for opening and closing door 12 is provided.

Having described my invention by reference to a preferred embodiment, I claim:

1. A combination latch and handle device comprising a housing, a handle pivotally attached to said housing, a latch having a button component and a keeper-engagable nose component, said latch being pivotally mounted on said handle and having its button component forming an extension thereof, a keeper on said housing adapted to receive said latch when said handle is moved to its closed position, and a mounting bracket engaging said housing;

said device further characterized by biasing means mounted on said housing and constructed and arranged to contact and restrain said latch in its latched position; said device further comprising a first additional biasing means engaging said housing and said handle whereby the handle and the latch are urged to the open position when the latch is disengaged from the keeper, and a second additional biasing means engaging said handle and said latch whereby the latch is urged to a position in which its handle-extended outer surface is contiguous with the outer surface of said handle.

2. The combination of claim 1 in which the biasing means comprises a leaf spring.

3. A combination latch and handle device comprising a housing, a handle pivotally attached to said housing, an arm extending from said handle, a stop on said arm positioned to engage the inner surface of a cabinet when said handle is moved to a closed position, a latch pivotally mounted on said handle and forming an extension thereof, a keeper on said housing adapted to receive said latch when said handle is moved to its closed position, first biasing means engaging said housing and said handle whereby the handle and the latch are urged to the open position when the latch is disengaged from the keeper, second biasing means engaging said handle and said latch whereby the latch is urged to a position in which its handle-extended outer surface is contiguous with the outer surface of said handle, a flange on said housing for engagement with the outer surface of the door when said housing is inserted fully into an opening in the door, and a mounting bracket engaging said housing;

said device further characterized by a leaf spring mounted on said housing and positioned to contact and restrain said latch in its latched position.

4. The device of claim 3 in which the pivotally mounted latch is provided with a flat outer surface and the handle is provided with a flat outer surface in which said flat outer surfaces are contiguous with each other when the combination is in closed and latched position.

5. The device of claim 4 in which the flat outer surface of said latch provides a latch disengagement button for moving the latch out of engagement with the keeper.

6. The device of claim 5 further characterized by a threaded boss affixed to said housing and a cross web comprising a portion of said housing and forming a part of said threaded boss.

7. A combination latch and handle device comprising a housing, a handle pivotally attached to said housing, a latch pivotally mounted on said handle and forming an extension thereof, a keeper on said housing adapted to receive said latch when said handle is moved to a closed position, a mounting bracket engaging said housing, and biasing means mounted on said housing and constructed and arranged to contact and restrain said latch in its latched position, said biasing means comprising means for:

(a) providing relatively high resistance to the initial pivotal movement of said latch out of said latched position, (b) providing increased resistance to the further pivotal movement of said latch out of said latched position, and (c) providing relatively low resistance to the final pivotal movement of said latch into an unlatched position.

8. The device of claim 7, wherein said biasing means comprises a leaf spring having a pair of substantially parallel spaced-apart portions and a beveled portion connecting said spaced-apart portions together.

9. The device of claim 7, wherein said latch comprises a button component and a keeper-engagable nose component and wherein said button component forms the extension of said handle.

10. The device of claim 7, wherein said biasing means is in detachable contact with said latch.

11. The device of claim 7, further comprising a first additional biasing means engaging said housing and said handle whereby the handle and the latch are urged to the open position when the latch is disengaged from the keeper, and a second additional biasing means engaging said handle and said latch whereby the latch is urged to a position in which its handle-extended outer surface is contiguous with the outer surface of said handle.

12. The latch of claim 11, wherein said biasing means comprises a leaf spring, wherein said first additional biasing means comprises a wire spring, and wherein said second additional biasing means comprises a coil spring.

* * * * *